US008833914B2

(12) United States Patent
Kanbe

(10) Patent No.: US 8,833,914 B2
(45) Date of Patent: Sep. 16, 2014

(54) IMAGE RECORDING APPARATUS AND LIQUID CARTRIDGE

(71) Applicant: Tomohiro Kanbe, Nagoya (JP)

(72) Inventor: Tomohiro Kanbe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/040,949

(22) Filed: Sep. 30, 2013

(65) Prior Publication Data

US 2014/0098145 A1 Apr. 10, 2014

(30) Foreign Application Priority Data

Oct. 10, 2012 (JP) ..... 2012-225248
Oct. 19, 2012 (JP) ..... 2012-232289

(51) Int. Cl.
*B41J 2/175* (2006.01)

(52) U.S. Cl.
CPC ..... *B41J 2/17556* (2013.01); *B41J 2/17503* (2013.01)
USPC ..... 347/86

(58) Field of Classification Search
USPC ..... 347/84–87, 89
See application file for complete search history.

(56) References Cited

U.S. PATENT DOCUMENTS

| | | | | |
|---|---|---|---|---|
| 5,136,309 | A | 8/1992 | Iida et al. | |
| 5,623,290 | A | 4/1997 | Iida et al. | |
| 5,997,121 | A * | 12/1999 | Altfather et al. | 347/86 |
| 6,012,795 | A | 1/2000 | Saito et al. | |
| 8,240,826 | B2 * | 8/2012 | Fukushima et al. | 347/86 |
| 8,690,300 | B2 * | 4/2014 | Nishioka et al. | 347/86 |

FOREIGN PATENT DOCUMENTS

| | | | |
|---|---|---|---|
| JP | S59-204567 | A | 11/1984 |
| JP | S63-057238 | A | 3/1988 |
| JP | H05-332812 | A | 12/1993 |
| JP | 2005-111955 | A | 4/2005 |
| JP | 2006-231528 | A | 9/2006 |

* cited by examiner

*Primary Examiner* — Kristal Feggins
(74) *Attorney, Agent, or Firm* — Baker Botts L.L.P.

(57) ABSTRACT

An image recording apparatus includes a liquid chamber, a first path having a flow resistance R, a second path, a recording head configured such that a predetermined operation of the recording head causes liquid to flow to the recording head at a flow rate greater than or equal to a minimum flow rate I, a pressure responsive portion including a membrane configured to move in response to the internal pressure of the second path and configured to move when a pressure differential between inside and outside of the membrane is greater than or equal to a minimum pressure differential ΔP, a detector configured to detect a position of the membrane, and a controller configured to determine presence of the liquid in the liquid chamber based on detection by the detector. The following condition is satisfied: flow resistance R≥(minimum pressure differential ΔP/minimum flow rate I).

13 Claims, 7 Drawing Sheets

IMAGE RECORDING APPARATUS AND LIQUID CARTRIDGE

CROSS REFERENCE TO RELATED APPLICATION

The present application claims priority to and the benefit of Japanese Application No. JP-2012-225248, which was filed on Oct. 10, 2012, and Japanese Application No. JP-2012-232289, which was filed on Oct. 19, 2012, the disclosures of which are incorporated herein by reference in their entirety.

BACKGROUND OF THE INVENTION

1. Field of the Invention

The present invention relates to an image recording apparatus, in which liquid is supplied from a liquid chamber to a recording head, and to a liquid cartridge comprising the liquid chamber.

2. Description of Related Art

In a known image recording apparatus, ink is supplied to a recording head via a flow path from an ink cartridge or an ink tank storing ink therein. When the ink stored in the ink cartridge or ink tank is used up, the ink cartridge needs to be replaced or the ink tank needs to be refilled with ink. For the replacement or for the refill, there is a known technology enabling determination of a remaining amount of ink in the ink cartridge or the ink tank with an optical detector. For example, in a known image recording apparatus, as described in Patent Application Publication No. JP 5-332812 A, an ink cartridge has a wall and an optical-path plate provided in the wall. When the inner surface of the optical-path plate contacts ink, the optical-path plate allows light to pass therethrough into the ink. When the inner surface of the optical-path plate does not contact ink, light is totally reflected at the inner surface. By detecting whether or not light emitted from a light emitter is totally reflected, a remaining amount of ink in the ink cartridge is determined.

A known image recording apparatus, as described in Patent Application Publication Nos. JP 59-204567 A, 63-57238 A, 2006-231528 A, or 2005-111955 A, has a space in fluid communication with an ink chamber for storing ink. The space is at least partly defined by a membrane. When ink is consumed, the volume of the space decreases while the membrane deforms. By detecting the deformation of the membrane, a remaining amount of ink in the ink chamber is determined.

In the known image recording apparatus as described in Patent Application Publication No. JP 5-332812 A, when the optical-path plate is tainted by dried ink, the remaining amount of ink may not be accurately determined. In the known image recording apparatus as described in Patent Application Publication Nos. JP 59-204567 A, 63-57238 A, 2006-231528 A, or 2005-111955 A, the ink chamber is air-tight, i.e., is not in fluid communication with atmospheric air. When the ink chamber is air-tight, the ink chamber needs to shrink in order for ink to smoothly flow out of the ink chamber. For that reason, the ink chamber is conventionally defined by a bag (pouch), which may shrink easily. Nevertheless, there may not be a wide range of variety of materials for making the shrinkable bag. Moreover, when the ink chamber defined by the bag is positioned in a rectangular parallelepiped casing of the ink cartridge, the ink-storing capacity relative to the inner volume of the casing may not be high.

SUMMARY OF THE INVENTION

Therefore, a need has arisen for an image recording apparatus and a liquid cartridge, which overcome these and other shortcomings of the related art. A technical advantage of the present invention is that the absence or presence of liquid in a liquid chamber may be determined when the liquid chamber is in fluid communication with atmospheric air.

According to an embodiment of the present invention, an image recording apparatus comprises a liquid chamber configured to store liquid therein and configured to be in fluid communication with atmospheric air, and a first path configured to allow the liquid to flow out of the liquid chamber therethrough. The first path has a flow resistance R when the liquid flows through the first path. The image recording apparatus further comprises a second path configured to be connected to the first path, and the second path has an internal pressure. The image recording apparatus further comprises a recording head configured to eject the liquid supplied via the second path, and the recording head is configured such that a predetermined operation of the recording head causes the liquid to flow to the recording head at a flow rate greater than or equal to a minimum flow rate I. The image recording apparatus further comprises a pressure responsive portion comprising a membrane configured to move in response to the internal pressure of the second path and configured to move when a pressure differential between inside and outside of the membrane is greater than or equal to a minimum pressure differential $\Delta P$, a detector configured to detect a position of the membrane, and a controller configured to determine absence or presence of the liquid in the liquid chamber based on detection by the detector. The flow resistance R, the minimum pressure differential $\Delta P$, and the minimum flow rate I are set, such that the following condition is satisfied: flow resistance $R \geq$(minimum pressure differential $\Delta P$/minimum flow rate I).

According to another embodiment of the present invention, a liquid cartridge is configured to be removably mounted to a cartridge mounting portion and to supply liquid to a recording head via the cartridge mounting portion, and the recording head is configured to eject the liquid and configured such that a predetermined operation of the recording head causes the liquid to flow to the recording head at a flow rate greater than or equal to a minimum flow rate I. The liquid cartridge comprises a liquid chamber configured to store the liquid therein and configured to be in fluid communication with atmospheric air, and a first path configured to allow the liquid to flow out of the liquid chamber therethrough. The first path has a flow resistance R when the liquid flows through the first path. The liquid cartridge further comprises a second path configured to be connected to the first path, and the second path has an internal pressure. The liquid cartridge further comprises a pressure responsive portion comprising a membrane configured to move in response to the internal pressure of the second path and configured to move when a pressure differential between inside and outside of the membrane is greater than or equal to a minimum pressure differential $\Delta P$. The flow resistance R, the minimum pressure differential $\Delta P$, and the minimum flow rate I are set, such that the following condition is satisfied: flow resistance $R \geq$(minimum pressure differential $\Delta P$/minimum flow rate I).

According to another embodiment, a liquid cartridge comprises a liquid chamber configured to store liquid therein and configured to be in fluid communication with atmospheric air, a first path configured to allow the liquid to flow out of the liquid chamber therethrough, a second path configured to be connected to the first path and the second having an internal pressure, and a pressure responsive portion comprising a membrane configured to move in response to the internal pressure of the second path and configured to move when a pressure differential between inside and outside of the membrane is greater than or equal to a minimum pressure differential.

Other objects, features, and advantages will be apparent to persons of ordinary skill in the art from the following detained description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawings.

DETAILED DESCRIPTION OF EMBODIMENTS OF THE INVENTION

Embodiments of the present invention, and their features and advantages, may be understood by referring to FIGS. 1-7, like numerals being used for like corresponding parts in the various drawings.

Figure 1:
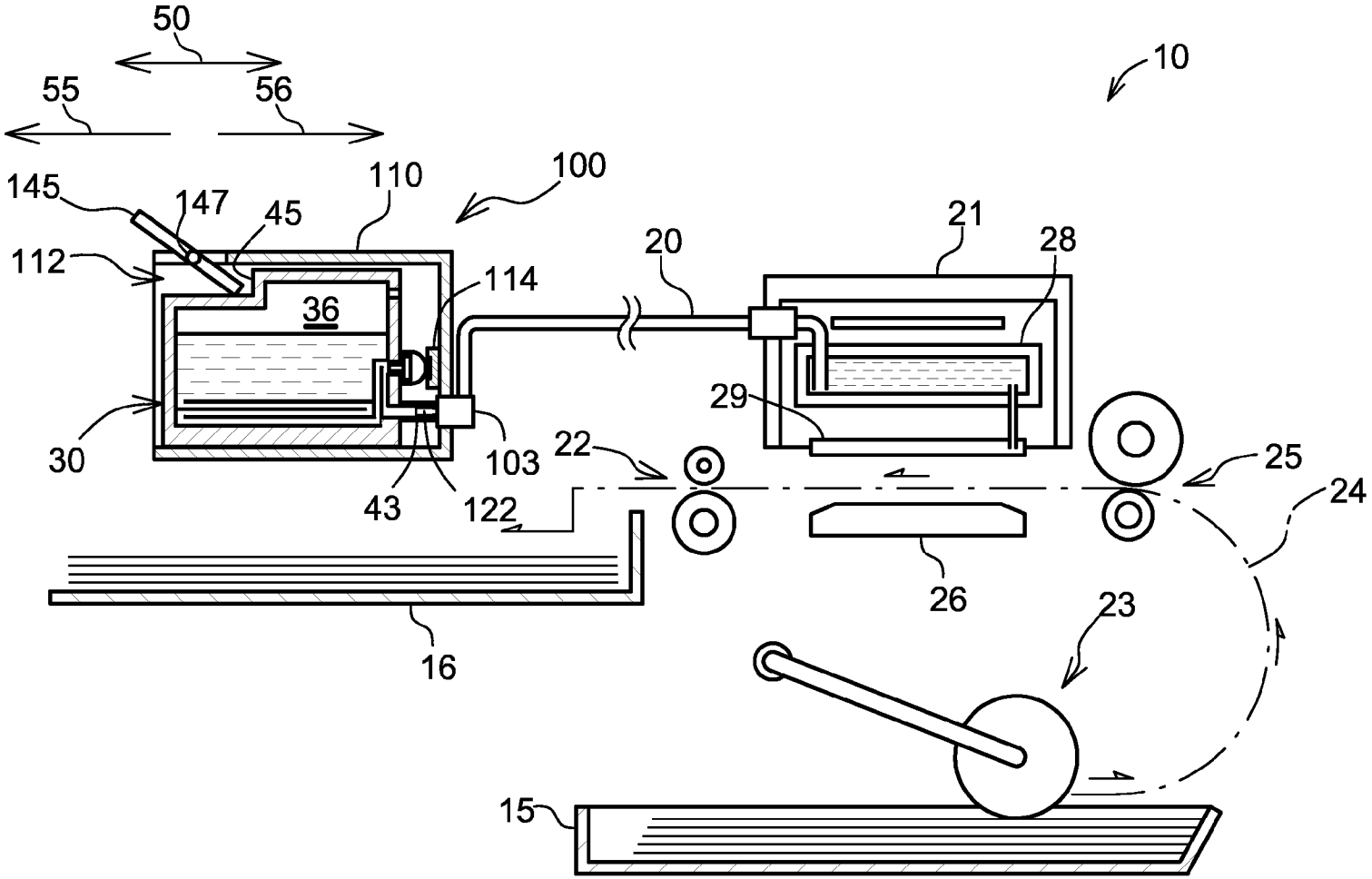
FIG. 1 is a schematic, cross-sectional view of a printer according to an embodiment.

Referring to FIG. 1, an image recording apparatus, e.g., a printer 10, is configured to selectively eject ink onto a recording medium, e.g., a sheet of paper, to record an image thereon, using a so-called ink-jet recording method. Printer 10 comprises a liquid supply device, e.g., an ink supply device 100, and ink supply device 100 comprises a cartridge mounting portion 110. Ink supply device 100 comprises a liquid cartridge, e.g., an ink cartridge 30, and ink cartridge 30 is configured to be removably mounted to the cartridge mounting portion 110. Cartridge mounting portion 110 has an opening 112 formed therein and the inside of cartridge mounting portion 110 is exposed to the outside of cartridge mounting portion 110 via opening 112. Ink cartridge 30 is configured to be inserted into cartridge mounting portion 110 via the opening 112, such that ink cartridge 30 is mounted to cartridge mounting portion 110. Ink cartridge 30 is configured to be removed from cartridge mounting portion 110 via the opening 112. Cartridge mounting portion 110 comprises a liquid introduction tube, e.g., an ink introduction tube 122, and ink introduction tube 122 is configured to be inserted into ink cartridge 30 when ink cartridge 30 is mounted to cartridge mounting portion 110.

Ink cartridge 30 is configured to store ink, which is used by printer 10. Printer 10 comprises a recording head 29, a sub tank 28, and a flexible ink tube 20. Ink cartridge 30 and recording head 29 are fluidically connected via ink tube 20 and sub tank 28 when ink cartridge 30 is mounted in cartridge mounting portion 110. Printer 10 comprises a carriage 21, and sub tank 28 and recording head 29 are mounted on carriage 21. Sub tank 28 is configured to temporarily store ink supplied via ink tube 20 from ink cartridge 30. Carriage 21 is configured to reciprocate in a scanning direction, which is perpendicular to a direction in which the sheet of paper is conveyed and also perpendicular to the sheet of FIG. 1, along a surface of the sheet of paper when a driving force is transmitted to carriage 21 from a motor (not shown). Recording head 29 is configured to selectively eject ink supplied from sub tank 28 while reciprocating in the scanning direction together with carriage 21. More specifically, carriage 21 and recording head 29 are configured to make a one-way movement from a first end to a second end in the scanning direction, and then make another one-way movement from the second end to the first end in the scanning direction. Carriage 21 and recording head 29 are configured to repeat these movements while recording head 29 ejects ink onto the sheet of paper during printing.

Printer 10 comprises a paper feed tray 15, a paper feed roller 23, a conveying roller pair 25, a platen 26, a discharge roller pair 22, a paper discharge tray 16. Printer 10 has a conveying path 24 formed therein, which extends from paper feed tray 15 to paper discharge tray 16. Conveying path 24 extends between conveying roller pair 25, between recording head 29 and platen 26, and between discharge roller pair 22. Paper feed roller 23 is configured to feed a sheet of paper from paper feed tray 15 to conveying path 24. Conveying roller pair 25 is configured to convey the sheet of paper fed from paper feed tray 15 onto platen 26. Recording head 29 is configured to selectively eject ink onto the sheet of paper passing over platen 26 while reciprocating in the scanning direction together with carriage 21. Accordingly, an image is recorded on the sheet of paper. Discharge roller pair 22 is configured to discharge the sheet of paper having passed over platen 26 to paper discharge tray 16 disposed at the most downstream side of conveying path 24.

The structure of printer 10 describe above is just an example. Another known structure can be applied with another way of feeding a sheet of paper, another way of conveying a sheet of paper, and/or another shape of a conveying path.

Figure 2:
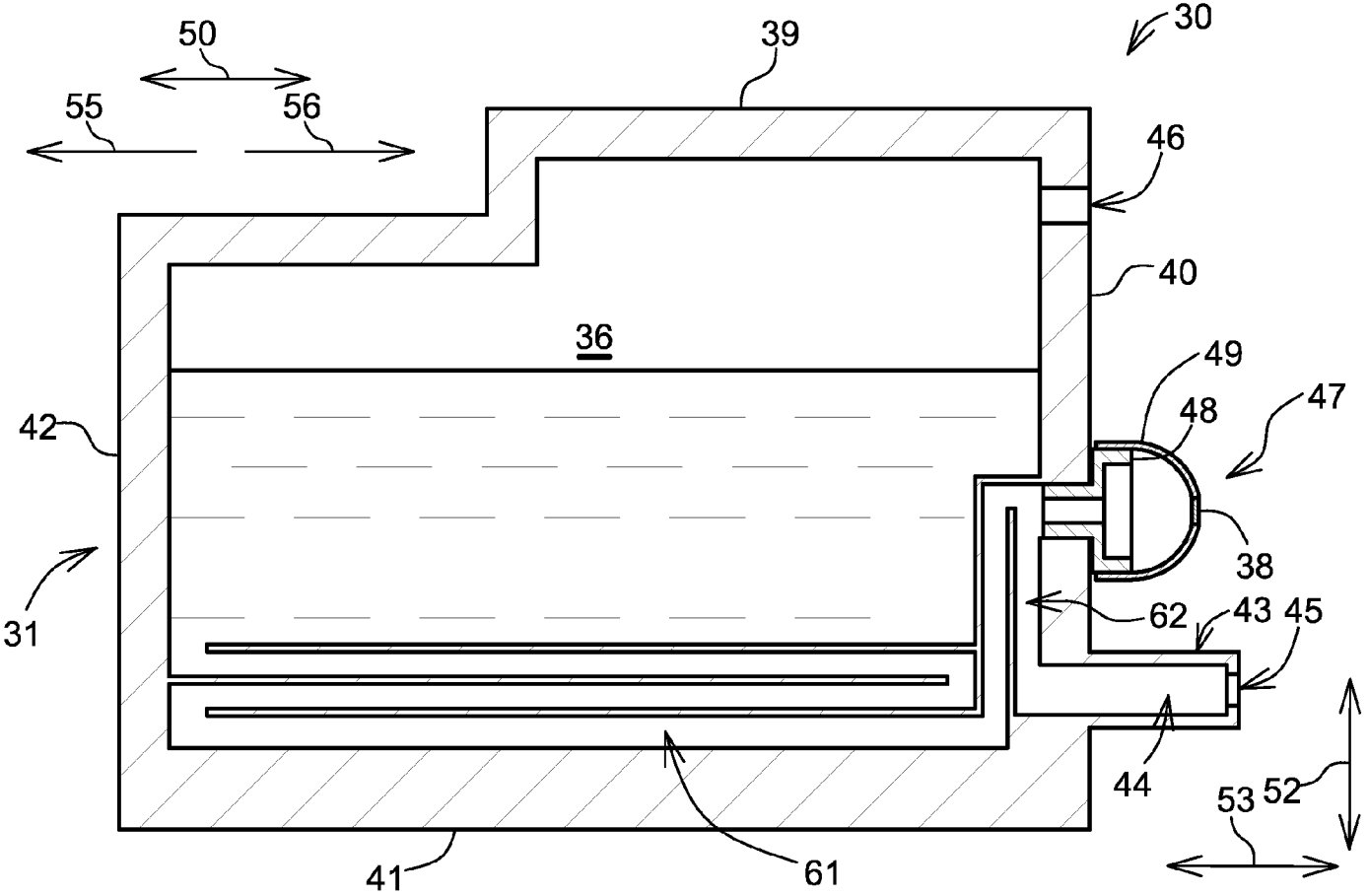
FIG. 2 is a vertical, cross-sectional view of an ink cartridge according to an embodiment.
Figure 3B:
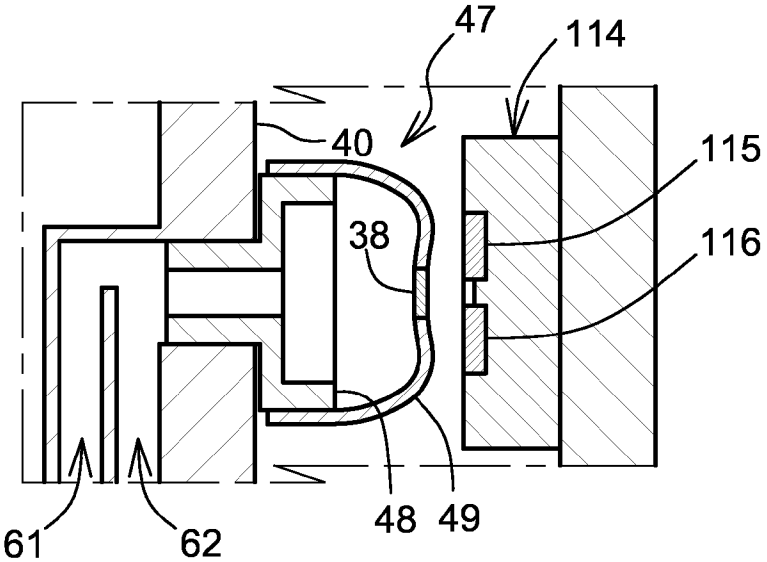
FIG. 3(B) is an expanded, cross-sectional view of the pressure responsive portion, in which the diaphragm rubber is in a deformed position where the diaphragm rubber is deformed into a space formed in the pressure responsive portion.

Referring to FIGS. 2 to 3(B), ink cartridge 30 is a container configured to store ink therein. Ink cartridge 30 comprises a liquid chamber, e.g., an ink chamber 36, which is a space formed in the interior of ink cartridge 30. Ink cartridge 30 also comprises a case 31 forming the exterior of ink cartridge 30. Ink chamber 36 is a space directly formed in the interior of case 31. In another embodiment, ink chamber 36 is a space formed in the interior of a container which is disposed in case 31.

Ink cartridge 30 is configured to be inserted into and removed from cartridge mounting portion 110 in an insertion/removal direction 50, while ink cartridge 30 is in an upright position, as shown in FIG. 2, with the top surface of ink cartridge 30 facing upward and the bottom surface of ink cartridge 30 facing downward. Ink cartridge 30 is in the upright position when ink cartridge 30 is mounted to the cartridge mounting portion 110 in a mounted position. Ink cartridge 30 is configured to be inserted into the cartridge mounting portion 110 in an insertion direction 56 and removed from the cartridge mounting portion 110 in a removal direction 55. Insertion/removal direction 50 is a combination of insertion direction 56 and removal direction 55. In this embodiment, insertion direction 56, removal direction 55, and insertion/removal direction 50 are horizontal directions. In another embodiment, insertion direction 56, removal direction 55, and insertion/removal direction 50 may be inclined relative to a horizontal plane.

Case 31 of ink cartridge 30 has a substantially parallelepiped shape. Case 31 has a width in a width direction, a height in a height direction 52, and a depth in a depth direction 53. The width direction, height direction 52, and depth direction 53 are perpendicular to each other. The width of case 31 is less than the height and the depth of case 31. When ink cartridge 30 is in the mounted position, the width direction is parallel with a horizontal plane, depth direction 53 also is parallel with the horizontal plane, and height direction 52 is parallel with the vertical direction, i.e., the gravitational direction. When ink cartridge 30 is inserted into/removed from cartridge mounting portion 110, depth direction 53 is parallel with insertion/removal direction 50, and the width direction and height direction 52 are perpendicular to insertion/removal direction 50.

Case 31 comprises a front wall 40 and a rear wall 42. Front wall 40 is disposed on a front side of case 31 with respect to insertion direction 56 in which ink cartridge 30 is inserted into cartridge mounting portion 110. Rear wall 42 is disposed on a rear side of case 31 with respect to insertion direction 56. Font wall 40 and rear wall 42 at least partly overlap in depth direction 53. Front wall 40 and rear wall 42 at least partly overlap in insertion/removal direction 50 in which direction ink cartridge 30 is inserted or removed into/from cartridge mounting portion 110. Case 31 comprises side walls (not shown), each extending in insertion/removal direction 50 and connected to front wall 40 and rear wall 42. The side walls at least partly overlap in the width direction. Case 31 comprises a top wall 39 connected to the upper ends of front wall 40, rear wall 42, and the side walls. Case 31 comprises a bottom wall 41 connected to the lower ends of front wall 40, rear wall 42, and the side walls. Top wall 39 and bottom wall 41 at least partly overlap in height direction 52.

Ink cartridge 30 comprises ink supply portion 43 positioned at a lower portion of front wall 40 with respect to height direction 52. In this embodiment, ink supply portion 43 has a circular, cylindrical outer shape, and extends outward from front wall 40 in depth direction 53, i.e., insertion direction 56. Ink supply portion 43 may have an end disposed farthest from front wall 40, and an ink supply opening 45 is formed in the end of ink supply portion 43. Ink supply opening 45 is open to the exterior of case 31. Ink supply portion 43 has an ink supply path 44 formed therein, and ink supply path 44 extends in depth direction 53, i.e., insertion/removal direction 50, from ink supply opening 45. Ink cartridge 30 comprises a first outflow path 61 and a second outflow path 62 formed in case 31, and ink supply path 44 is configured to be in fluid communication with ink chamber 36 via first outflow path 61 and second outflow path 62.

Ink supply opening 45 is closed liquid-tightly by a film (not shown) covering the ink supply opening 45 or by a valve (not shown) disposed in ink supply path 44. When ink cartridge 30 is mounted to cartridge mounting portion 110 and ink introduction tube 122 is inserted through ink supply opening 45, the film is torn by ink introduction tube 122 or the valve is opened by ink introduction tube 122. The end of ink supply portion 43 comprises a portion defining an ink supply opening 45, and the portion is made of a resilient member, e.g., rubber, such that the portion contacts the outer surface of ink introduction tube 122 liquid-tightly.

Ink cartridge 30 comprises an air communication portion 46 positioned at an upper portion of front wall 40 with respect to height direction 52. Air communication portion 46 comprises an opening formed through front wall 46 at a position where an air layer is formed in ink chamber 36. The opening of air communication portion 46 is closed liquid-tightly by a film (not shown) covering the opening or by a valve (not shown) disposed in air communication portion 46. When ink cartridge 30 is mounted to cartridge mounting portion 110, the film is torn or the valve is opened, such that the air layer in ink chamber 36 is in fluid communication with atmospheric air outside ink cartridge 30 via the opening of air communication portion 46. In another embodiment, air communication portion 46 may comprise a so-called labyrinth path, and the air layer in ink chamber 36 may be in fluid communication with atmospheric air outside ink cartridge 30 via the labyrinth path. When the air layer in ink chamber 36 is in fluid communication with atmospheric air outside ink cartridge 30, air enters ink chamber 36 via air communication portion 46 and contacts ink stored in ink chamber 36.

Ink cartridge 30 comprises a pressure responsive portion 47 positioned at a middle portion of front wall 40 with respect to height direction 52. Pressure responsive portion 47 comprises a tube portion 48 extending outward from front wall 40 in depth direction 53, i.e., insertion direction 56. In this embodiment, tube portion 48 has a circular, cylindrical shape. Tube portion 48 has an inner space formed therein, and the inner space is opened to the outside of tube portion 48 at the both ends of tube portion 48 with respect to depth direction 53, i.e., insertion/removal direction 50. Tube portion 48 comprises a base portion and an end portion, and the outer diameter of the base portion is less than the outer diameter of the end portion. The base portion extends through front wall 40 in depth direction 53, i.e., insertion/removal direction 50, and the end portion is positioned outside case 31. The inner space of tube portion 48 is opened to the outside of tube portion 48 in insertion direction 56 at the end portion. Pressure responsive portion 47 comprises a membrane, e.g., a diaphragm rubber 49, attached to the end portion of tube portion 48 to cover the opening of the end portion of tube portion 48. In other words, pressure responsive portion 47 has a space formed therein, and the space of pressure responsive portion 47 is defined by tube portion 48 and diaphragm rubber 49. The size of the inner space of tube portion 48 is reduced at the base portion of tube portion 48 and the inner space is opened to the outside of tube portion 48 in removal direction 55 at the base portion, such that the inner space of tube portion 48 is connected to second outflow path 62, i.e., the space formed in pressure responsive portion 47 is connected to second outflow path 62.

Figure 3A:
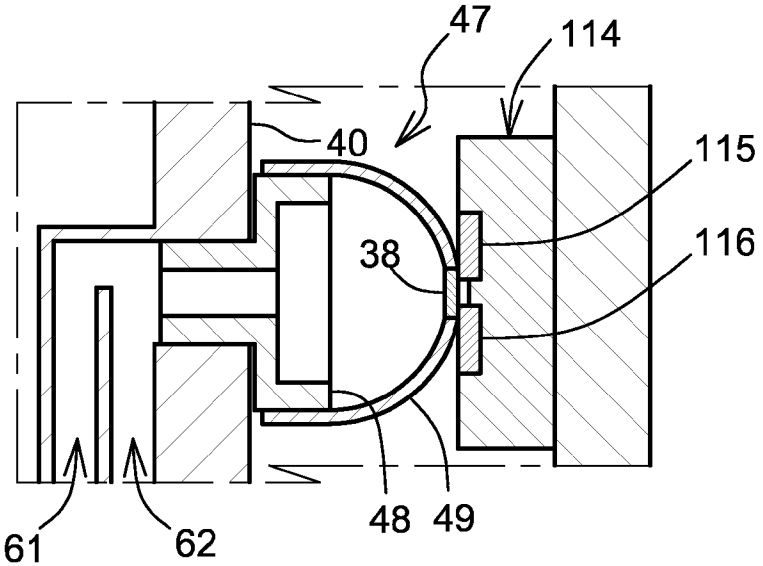
FIG. 3(A) is an expanded, cross-sectional view of a pressure responsive portion, in which a diaphragm rubber has a dome shape.

Diaphragm rubber 49 has a dome shape extending from the end portion of tube portion 48, such that the opening of the end portion of tube portion 48 is covered. Diaphragm rubber 49 is a deformable membrane. Diaphragm rubber 49 at least partly defines the space formed in pressure responsive portion 47. The space formed in pressure responsive portion 47 is configured to be filled with ink. Referring to FIGS. 3(A) and 3(B), the shape of diaphragm rubber 49 changes based on a pressure differential between an atmospheric pressure Pa outside diaphragm rubber 49 and the internal pressure of the space formed in pressure responsive portion 47, i.e., the pressure of ink in the space formed in pressure responsive portion 47. More specifically, diaphragm rubber 49 maintains the dome shape as shown in FIG. 3(A) or diaphragm rubber 49 is in a deformed position where diaphragm rubber 49 is deformed into the space as shown in FIG. 3(B). In other words, diaphragm rubber 49 is configured to move in response to the internal pressure of the space formed in pressure responsive portion 47, i.e., the pressure of ink in the space formed in pressure responsive portion 47.

Pressure responsive portion 47 comprises a conductive portion 38 on the outer surface of diaphragm rubber 49, and conductive portion 38 is positioned at the tip of the dome shape of diaphragm rubber 49 when diaphragm rubber 49 maintains the dome shape. Cartridge mounting portion 110 comprises a detector 114, and conductive portion 38 is made of a material which allows electric current supplied from detector 114 to flow therethrough. When ink cartridge 30 is mounted to cartridge mounting portion 110 and diaphragm rubber 49 moves, conductive portion 38 selectively contacts and separates from detector 114.

The space formed in pressure responsive portion 47 is connected to second outflow path 62 at the base portion of tube portion 48, i.e., the space formed in pressure responsive portion 47 meets second outflow path 62 at the base portion of tube portion 48. Second outflow path 62 extends downward along front wall 40 toward bottom wall 41 from the meeting point with the space formed in pressure responsive portion 47, and is connected to ink supply path 44 at the lower end of second outflow path 62, i.e., second outflow path 62 meets ink supply path 44 at the lower end of second outflow path 62. Second outflow path 62 does not necessarily have a width extending along the whole width of case 31 in the width direction, but may have a width less than the width of case 31, having a smaller cross sectional area. In this embodiment, second outflow path 62, ink supply path 44, and ink tube 20 are an example of a second path.

Second outflow path 62 is connected to first outflow path 61 at the upper end of second outflow path 62, i.e., second outflow path 62 meets first outflow path 61 at the upper end of second outflow path 62. At the upper end of second outflow path 62, second outflow path 62 is connected to the space formed in pressure responsive portion 47 in insertion direction 56 and is connected to first outflow path 61 in removal direction 55. First outflow path 61 extends downward along front wall 40 toward bottom wall 41 from the meeting point with second outflow path 62, and then extends along bottom wall 41, making U-turns several times between front wall 40 and rear wall 42, and is connected to ink chamber 36, i.e., meets ink chamber 36. In other words, first outflow path 61 extends in removal direction 55 and insertion direction 56 in a zigzag manner like a winding road. Ink stored in ink chamber 36 flows out of ink chamber 36 though first outflow path 61 and reaches second outflow path 62, the space in the pressure responsive portion 47, and ink supply path 44. First outflow path 61 does not necessarily have a width extending along the whole width of case 31 in the width direction, but may have a width less than the width of case 31, having a smaller cross sectional area. In this embodiment, first outflow path 61 is an example of a first path.

The first outflow path 61 has a flow resistance R when ink stored in ink chamber 36 flows through the first outflow path 61. Diaphragm rubber 49 is configured to move when a pressure differential between the inside and the outside of diaphragm rubber 49 is greater than or equal to a minimum pressure differential ΔP. Recording head 29 is configured such that a predetermined operation of recording head 29 causes the ink to flow to recording head 29 at a flow rate greater than or equal to a minimum flow rate I. Flow resistance R, minimum pressure differential ΔP, and minimum flow rate I are set, such that the following condition No. 1 is satisfied:

$$\text{flow resistance } R \geq (\text{minimum pressure differential } \Delta P / \text{minimum flow rate } I).$$

The pressure differential between the inside and the outside of diaphragm rubber 49 is a value obtained by subtracting a pressure value on the inner surface of diaphragm rubber 49 facing the space formed in pressure responsive portion 47 from a pressure value on the outer surface of diaphragm rubber 49 contacting atmospheric air.

Because ink chamber 36 is in fluid communication with the atmosphere via air communication portion 46, the pressure of ink stored in ink chamber 36 is equal to atmospheric pressure Pa. When the ink is not flowing from first outflow path 61 to recording head 29, the pressure of the ink in first outflow path 61, second outflow path 62, and the space formed in pressure responsive portion 47 also is equal to atmospheric pressure Pa. Because the pressure outside diaphragm rubber 49 also is equal to atmospheric pressure Pa, the pressure differential between the inside and the outside of diaphragm rubber 49 is zero, and therefore diaphragm rubber 49 does not move, i.e., does not deform.

When recording head 29 performs the predetermined operation, and the ink flows through first outflow path 61 at a flow rate greater than or equal to minimum flow rate I, a pressure loss occurs, which loss is greater than or equal to a product RI of flow resistance R and minimum flow rate I. Accordingly, the pressure of the ink in second outflow path 62 connected to first outflow path 61 becomes a value less than or equal to a value (Pa−RI) which is obtained by subtracting product RI from atmospheric pressure Pa. Since the pressure of the ink in the space formed in pressure responsive portion 47 connected to second outflow path 62 also becomes a value less than or equal to value (Pa−RI), the pressure differential between the inside and the outside of diaphragm rubber 49 becomes a value greater than or equal to a value RI which is obtained by subtracting value (Pa−RI) from atmospheric pressure Pa acting on the outer surface of diaphragm rubber 49. According to condition No. 1 as described above, value RI is greater than or equal to minimum pressure differential ΔP, and therefore diaphragm rubber 49 moves, i.e., diaphragm rubber 49 is deformed into the deformed position. In other words, minimum flow rate I is a minimum flow rate of the ink for diaphragm rubber 49 to move, i.e., to be deformed into the deformed position.

The flow resistance of first outflow path 61 when air flows through first outflow path 61 is sufficiently less than flow resistance R when the ink flows through first outflow path 61, and therefore can be neglected, e.g., substantially zero. Therefore, when the ink stored in ink chamber 36 is consumed and air enters first outflow path 61, a pressure loss substantially does not occur at the portion of first outflow path 61 where air exists even if the ink flows to recording head 29. When first outflow path 61 is fully filled with air, a pressure loss substantially does not occur at first outflow path 61 even if the ink flows to recording head 29 at a flow rate greater than or equal to minimum flow rate I. Consequently, the pressure differential between the inside and the outside of diaphragm rubber 49 is substantially zero, and therefore diaphragm rubber 49 does not move, i.e., does not deform.

As described above, whether diaphragm rubber 49 moves, i.e., whether diaphragm rubber 49 is in the deformed position, when recording head 29 performs the predetermined operation depends on whether air exists in first outflow path 61, i.e., whether the ink is still in ink chamber 36. Therefore, the absence or presence of the ink in the ink chamber 36 can be determined by detecting the position of diaphragm rubber 49, i.e., by detecting whether diaphragm rubber 49 is in the deformed position.

First outflow path 61 comprises a connection portion configured to be directly connected to second outflow path 62, and the connection portion has a flow resistance R' when the ink flows though the connection portion. Preferably, low resistance R', minimum pressure differential ΔP, and minimum flow rate I are set, such that the following additional condition No. 2 is satisfied:

flow resistance $R'$<(minimum pressure differential ΔP/minimum flow rate $I$).

When air enters first outflow path 61 and only the connection portion is filled with the ink in first outflow path 61, a pressure loss occurs, which loss is a product R'I of flow resistance R' and minimum flow rate I if the ink flows to recording head 29 at minimum flow rate I. Since product R'I is less than minimum pressure differential ΔP, diaphragm rubber 49 does not move. Therefore, it can be determined that ink chamber 36 becomes empty of the ink before first outflow path 61 has become completely filled with air.

Incidentally, when recording head 29 performs the predetermined operation, the ink flows to recording head 29 at a flow rate I', which is greater than or equal to minimum flow rate I. Therefore, even when only the connection portion is filled with the ink in first outflow path 61, a product R'I' of flow resistance R' and flow rate I' may not be less than minimum pressure differential ΔP. Nevertheless, if the above-described additional condition No. 2 is satisfied, the likelihood becomes high that it can be determined that ink chamber 36 becomes empty of the ink before first outflow path 61 has become completely filled with air.

Referring to FIG. 1, cartridge mounting portion 110 comprises a case 101 having opening 112 formed therein. Ink cartridge 30 may be configured to be inserted into and removed from case 101 via opening 112. Case 101 may be configured to receive four ink cartridges 30 storing cyan ink, magenta ink, yellow ink, and black ink, respectively. FIG. 1 depicts a portion of case 101 corresponding to one of the four ink cartridges 30.

Case 101 may comprise an end surface disposed opposite from opening 112 in insertion/removal direction 50 and facing the inner space of case 101. Cartridge mounting portion 110 comprises a connection portion 103 disposed at a lower portion of the end surface of case 101. Four connection portions 103 are provided corresponding to the four ink cartridges 30. FIG. 1 depicts one of the four connection portions 103. Connection portion 103 is disposed at a position corresponding to ink supply portion 43 of ink cartridge 30 when ink cartridge is mounted to case 101.

Connection portion 103 comprises ink introduction tube 122. Ink introduction tube 122 is a cylindrical tube and connected to ink tube 20 via a connector at the outside of case 101. Ink tube 20 connected to ink introduction tube 122 extends to sub tank 28. Ink introduction tube 122 extends in insertion/removal direction 50. When ink cartridge 30 is mounted to cartridge mounting portion 110, ink introduction tube 122 is inserted through ink supply opening 45 of ink supply portion 43. Thus, the ink stored in ink chamber 36 is supplied to the outside of ink cartridge 30. More specifically, the ink flows out of ink chamber 36 into ink introduction tube 122 via first outflow path 61, second outflow path 62, and ink supply path 44, and is supplied to sub tank 28 and recording head 20 via ink tube 20.

Referring to FIGS. 1, 3(A), and 3(B), cartridge mounting portion 110 comprises a detector 114 disposed at a middle portion of the end surface of case 101. Four detectors 114 are provided corresponding to the four ink cartridges 30. FIG. 1 depicts one of the four detectors 114. Detector 114 is disposed at a position corresponding to pressure responsive portion 47 of ink cartridge 30 when ink cartridge is mounted to case 101. Detector 114 comprises a pair of conductive portions 115, 116 on its surface facing opening 112. Conductive portions 115 and 116 are spaced away from each other, in the vertical direction for example. Detector 114 is configured to output signals depending on the conductive state of conductive portions 115 and 116. When diaphragm rubber 49 of pressure responsive portion 47 maintains the dome shape, conductive portion 38 contacts conductive portions 115 and 116 as shown in FIG. 3(A), such that conductive portions 115 and 116 are electrically connected. When diaphragm rubber 49 is in the deformed position, conductive portion 38 is separated from conductive portions 115 and 116 as shown in FIG. 3(B), such that conductive portions 115 and 116 are not electrically connected. Thus, detector 114 is configured to detect the deformed position of diaphragm rubber 49 and output an electric signal.

Referring to FIG. 1, cartridge mounting portion 110 comprises a lock lever 145, and lock lever 145 is configured to retain ink cartridge 30 mounted in cartridge mounting portion 110 in the mounted position. Lock lever 145 is positioned close to opening 112.

Lock lever 145 comprises a support shaft 147 at its middle portion. Support shaft 147 is supported by case 101. Lock lever 145 is configured to pivot about support shaft 147. Lock lever 145 comprises a first end and a second end opposite the first end, and the first end of lock lever 145 is configured to be positioned in the inner space of case 101 and contact and retain ink cartridge 30, such that ink cartridge 30 does not move in removal direction 55. Ink cartridge 30 is thus retained in cartridge mounting portion 110 in the mounted position. When the second end of lock lever 145 is pressed down by a user and lock lever 145 pivots, the first end of lock lever 145 moves away from ink cartridge 30, such that ink cartridge 30 can be removed from cartridge mounting portion 110 in removal direction 55.

Figure 4:
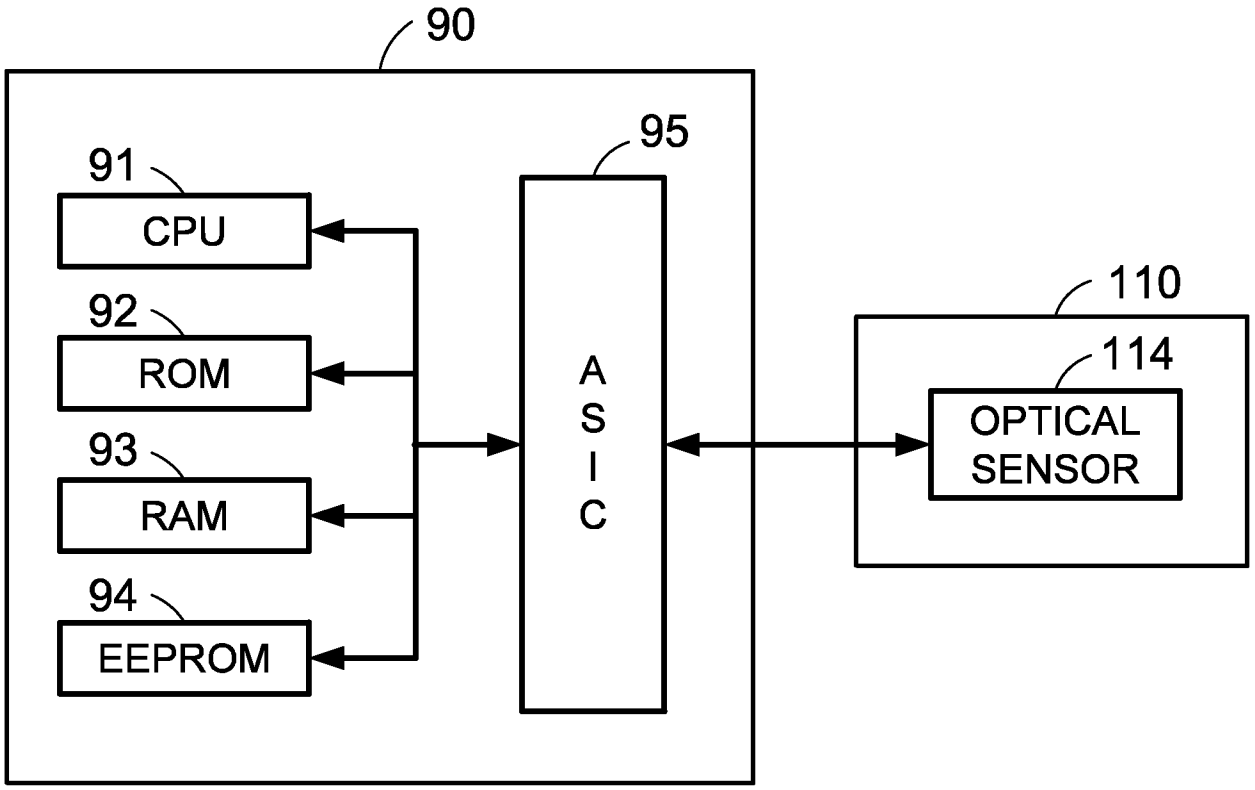
FIG. 4 is block diagram of a controller.

Referring to FIG. 4, printer 10 comprises a controller 90 configured to control the operation of printer 10. Controller 90 may comprise a CPU 91, a ROM 92, a RAM 93, an EEPROM 94, and an ASIC 95.

ROM 92 stores programs for CPU 91 to control various operations of printer 10 and to execute a determination process. RAM 93 is used as a storage area for temporarily store date and signals for CPU 91 to use in executing the programs and as a working area for date processing. EEPROM 94 stores settings and flags which may be retained even after the power is off.

ASIC 95 is connected to detector 114. ASIC 95 also is connected to a driving circuit for driving paper feed roller 23, conveying roller pair 25, etc. ASIC 95 also is connected to an input portion through which instructions for printing is input to printer 10, is connected to an interface through which controller 90 sends and receives data to/from an external device such as a personal computer, and is connected to a display which displays information about printer 10.

Detector 114 is configured to output an electric signal, e.g., current signal or voltage signal. The intensity of the signal depends on the conductive state of conductive portions 115 and 116. Controller 90 is configured to determine that the signal is a HI level signal when the value of the electric signal, e.g., voltage value or current value, is greater than or equal to a threshold value and that the signal is a LOW level signal when the value of the electric signal is less than the threshold value. In this embodiment, when diaphragm rubber 49 maintains the dome shape and conductive portion 38 contacts conductive portions 115 and 116, detector 114 outputs the LOW level signal. When diaphragm rubber 49 is in the deformed position and conductive portion 38 is positioned away from conductive portions 115 and 116, detector 114 outputs the HI level signal.

Figure 5:
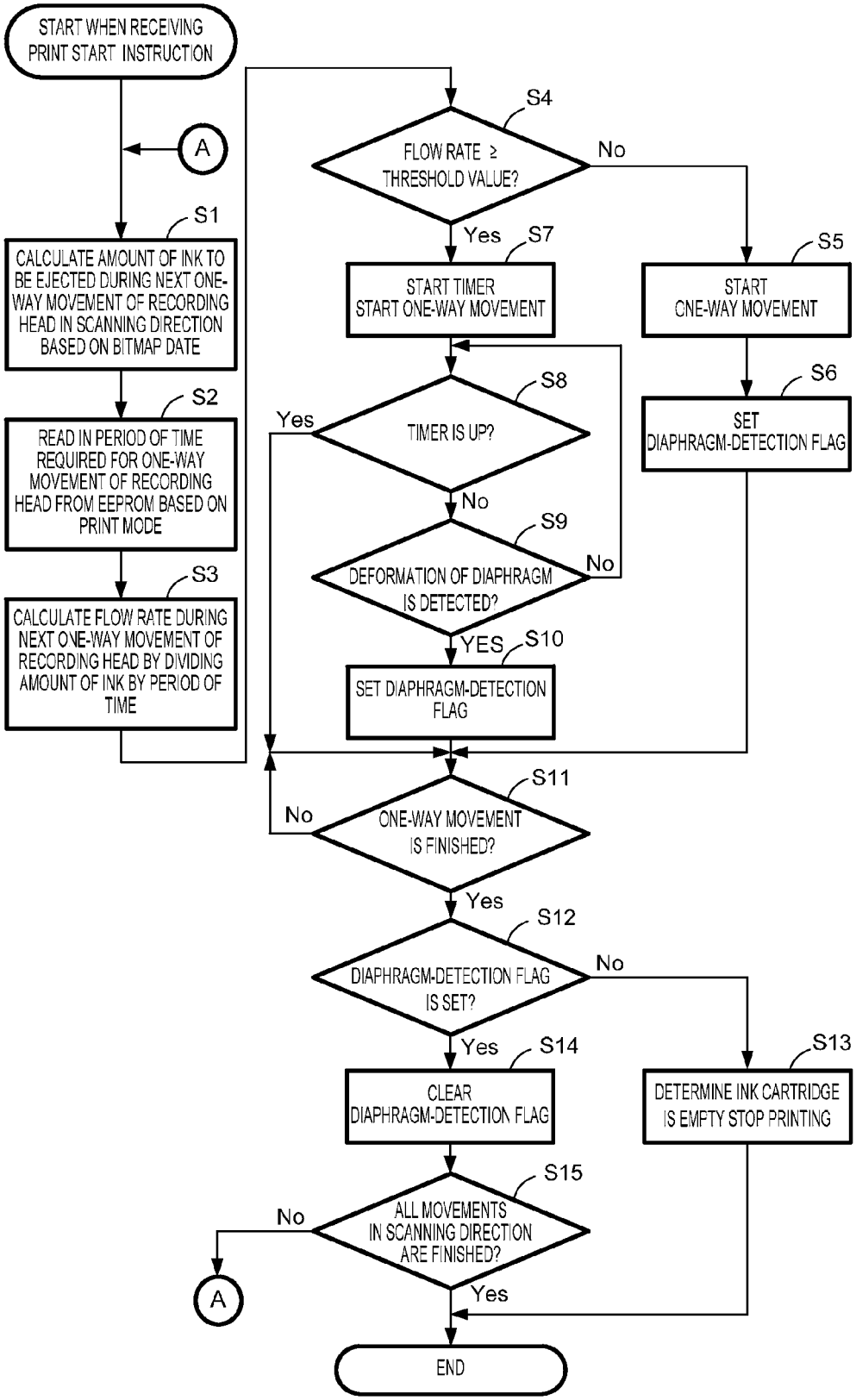
FIG. 5 is a flow chart as to how the controller determines the absence or presence of ink in an ink chamber.

Referring to FIGS. 3(A), 3(B), and 5, it will be described how controller 90 determines the absence or presence of the ink in ink chamber 36 of ink cartridge 30 mounted to cartridge mounting portion 110.

Controller 90 is configured to receive a print start instruction. For example, controller 90 is configured to receive the print start instruction from a printer driver installed in an external computer connected to printer 10. Controller 90 also is configured to receive the print start instruction when a user presses a start button at the input portion of printer 10.

In response to receiving the print start instruction, controller 90 estimates, e.g., calculates an amount of ink to be ejected by recording head 29 during the next one-way movement of carriage 21 and recording head 29 in the scanning direction based on bitmap date of print date of an image to be recorded by recording head 29 at step S1. The bitmap data indicates which size of an ink droplet, e.g., a larger-size droplet, a middle-size droplet, or a smaller-size droplet, is to be ejected onto which position of a sheet of paper. The bitmap date is created by the printer driver installed in the computer or by controller 90.

Controller 90 estimates a period of time required for a one-way movement of carriage 21 and recording head 29 based on print mode data included in the print data at step S2. For example, controller 90 reads in the period of time from EEPROM 94, in which a corresponding table of periods of time and print modes is stored. Print modes may comprise a high-resolution mode, in which carriage 21 and recording head 29 moves slowly and a low-resolution mode, in which carriage 21 and recording head 29 moves fast.

At step S3, controller 90 estimates, e.g., calculates a flow rate I" at which the ink flows from first outflow path 61 to recording head 29 during the next one-way movement of carriage 21 and recording head 29, by dividing the amount of ink calculated at step S1 by the period of time read at step S2.

At step S4, controller 90 determines whether calculated flow rate I" is greater than or equal to a threshold value. The threshold value is minimum flow rate I for diaphragm rubber 49 to move, i.e., to be deformed into the deformed position. If controller 90 determines that flow rate I" is less than flow rate I at step S4, controller 90 causes carriage 21 and recording head 29 to start the one-way movement in the scanning direction and causes recording head 29 to eject ink at step S5, and then set a diaphragm-detection flag in a resister of ASIC 95 at step S6. Incidentally, because flow rate I" is less than flow rate I, diaphragm rubber 49 does not move, but the diaphragm-detection flag is set at step S6 for determination purpose.

If controller 90 determines that flow rate I" is greater than or equal to flow rate I at step S4, controller 90 starts a timer in addition to causing carriage 21 and recording head 29 to start the one-way movement in the scanning direction and causing recording head 29 to eject ink at step S7. While monitoring whether the timer is up, i.e., monitoring whether a predetermined period of time has expired at step S8, controller 90 determines whether detector 114 outputs the HI level signal at step S9. The HI level signal indicates that diaphragm rubber 49 is in the deformed position. The one-way movement of recording head 29 in the scanning direction when it is determined that flow rate I" is greater than or equal to flow rate I is an example of the predetermined operation of recording head 29.

When ink chamber 36 has a remaining amount of ink therein, i.e., when the entirety of first outflow path 61 is filled with ink, and the ink flows though first outflow path 61 at flow rate I', which is greater than or equal to minimum flow rate I, a pressure loss occurs, which loss is a product RI' of flow resistance R and flow rate I'. Consequently, the internal pressure of the space formed in pressure responsive portion 47 decreases, and diaphragm rubber 49 moves into the deformed position. After that, when the ink flow becomes small and the internal pressure of the space formed in pressure responsive portion 47 increases, deformed diaphragm rubber 49 moves back into the dome shape. The ink in second outflow path 62 enters the space formed in pressure responsive portion 47 accordingly.

When ink chamber 36 is empty of ink and first outflow path 61 is filled with air, a pressure loss substantially does not occur at first outflow path 61 even if the ink flows to recording head 29 at flow rate I'. Consequently, diaphragm rubber 49 maintains the dome shape. In particular, if the above-described additional condition No. 2 is met, when only the connection portion is filled with the ink in first outflow path 61, a pressure loss required for diaphragm rubber 49 to move may not occur even if the ink flows to recording head 29 at flow rate I', and diaphragm rubber 49 may maintain the dome shape. The likelihood becomes high that diaphragm rubber 49 does not move any longer before first outflow path 61 has become completely filled with air.

When controller 90 determines that detector 114 outputs the HI level signal at step S9, controller 90 sets the diaphragm-detection flag in the resister of ACIS 95 at step S10. Controller 90 continues the determination of step S9 until the timer is up, i.e., until the predetermined period of time expires at step S8 or until controller 90 determines that detector 114 outputs the HI level signal at step S9. If controller 90 does not determine that detector 114 outputs the HI level signal and the timer is up at step S8, controller 90 does not set the diaphragm-detection flag.

After the diaphragm-detection flag is set at step S6 or step S10 or after timer is up at step S8, controller 90 determines whether the one-way movement of carriage 21 and recording head 29 in the scanning direction has finished at step S11. If controller 90 determines that the one-way movement has finished, controller 90 determines whether the diaphragm-detection flag is set at step S12. If not, controller 90 waits until the one-way movement finishes. If controller 90 determines that the diaphragm-detection flag is set at step S12, controller 90 clears the flag at step S14. If controller 90 determines that the diaphragm-detection flag is not set at step S12, controller 90 determines that ink cartridge 36 is empty of ink, and stops the printing at step S13, and may notify a user.

After clearing the flag at step S14, controller 90 determines whether all the movements of carriage 21 and recording head 29 in the scanning direction required for recording the image have finished at step S15. If controller 90 determines that not all the movements have finished at step S15, controller 90 estimates, e.g., calculates an amount of ink to be ejected by recording head 29 during the next one-way movement of carriage 21 and recording head 29 in the scanning direction at step S1 again. If controller 90 determines that all the movements have finished at step S15, controller 90 ends printing.

According to the embodiment described above, when ink flows to recording head 29 at flow rate I', which is greater than or equal to minimum flow rate I during a one-way movement of carriage 21 and recording head 29 in the scanning direction, whether diaphragm rubber 49 moves, i.e., whether diaphragm rubber 49 is in the deformed position, depends on whether a pressure loss which is greater than or equal to product RI of flow resistance R and minimum flow rate I occurs at first outflow path 61. By the detector 114 detecting the position of diaphragm rubber 49, the absence or present of ink in ink chamber 36 can be determined when ink chamber 36 is in fluid communication with atmospheric air.

Moreover, if the above-describe additional condition No. 2 is satisfied, the likelihood becomes high that it can be determined that ink chamber 36 becomes empty of the ink before first outflow path 61 has become completely filled with air. Accordingly, it is possible to notify a user that ink cartridge 30 should be replaced, before air enters ink introduction tube 122. By reducing the likelihood that air enters ink introduction tube 122, the number of a flushing operation of recording head 29 can be reduced. The flushing operation is an operation for forcibly ejecting ink from recording head 29 for maintenance purposes, not for the printing purpose, such as for removing air from recording head 29. In this embodiment, the flushing operation may comprise a so-called purging operation of recording head 29.

In another embodiment, the position of diaphragm rubber 49 may be detected optically or magnetically or with any other known method of detecting a position of an object.

Figure 6:
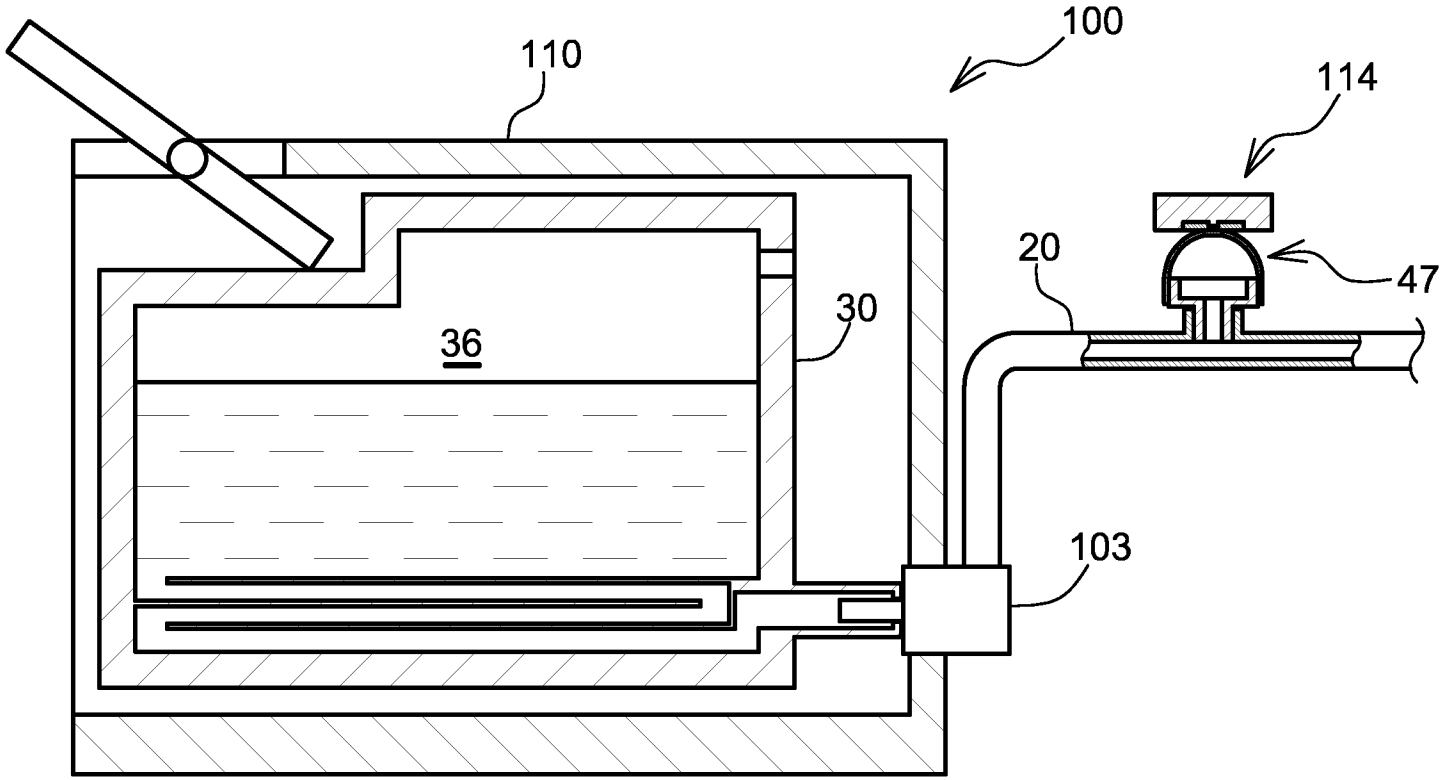
FIG. 6 is a vertical, cross-sectional view of an ink supply device, according to another embodiment.

Referring to FIG. 6, in another embodiment, pressure responsive portion 47 may be provided not at ink cartridge 30, but provided at somewhere between cartridge mounting portion 110 and carriage 21. For example, pressure responsive portion 47 may be provided at ink tube 20, and detector 114 may be provided at a position corresponding to pressure responsive portion 47 at ink tube 20.

In another embodiment, the structure of pressure responsive portion 47 may not be limited to tube portion 48 and diaphragm rubber 49 covering the opening of tube portion 48. For example, another pressure responsive portion may comprise a ball made of a flexible membrane and having air therein. The flexible ball is positioned in second outflow path 62, and the pressure of the air in the ball is equal to atmospheric pressure Pa. When first outflow path 61 is filled with ink and the ink flows through first outflow path 61 at a flow rate greater than or equal to minimum flow rate I, a pressure loss occurs at first outflow path 61 and the pressure in second outflow path 62 decreases. Consequently, the pressure differential between the inside and the outside of the ball made of a flexible membrane becomes greater than or equal to minimum pressure differential $\Delta P$, which causes the ball to bulge. When the ball bulges, the buoyancy acting on the ball increases and the ball moves up in second outflow path 62. On the other hand, when first outflow path 61 is filled with air, the ball does not bulge and does not move even if ink flows at a flow rate greater than or equal to minimum flow rate I. By optically detecting the position of the ball, i.e., the position of the membrane with light emitted from the outside of second outflow path 62, controller 90 can determine the absence or presence of ink in ink chamber 36.

In another embodiment, instead of determining whether estimated/calculated flow rate I" at which ink flows during the one-way movement of carriage 21 and recording head 29 in the scanning direction is greater than or equal to minimum flow rate I, controller 90 may determine whether estimated/calculated flow rate I" at which ink flows during the flushing operation is greater than or equal to minimum flow rate I. Controller 90 may determine the absence or presence of ink in ink chamber 36 within a predetermined amount of time since the flushing operation starts. In other words, the flushing operation may be one example of the predetermined operation of recording head 29.

In another embodiment, controller 90 may determine whether estimated/calculated flow rate I" required for recoding the entire image or part of the image is greater than or equal to minimum flow rate I. In other words, controller 90 may determine whether estimated/calculated flow rate I" at which ink flows during several one-way movements of carriage 21 and recording head 29 in the scanning direction is greater than or equal to minimum flow rate I. In other words, the predetermined operation of recording head 29 may comprise the several one-way movements of recording head 29 in the scanning direction when it is determined that flow rate I" is greater than or equal to flow rate I.

In another embodiment, if a recording head is a line head, which does not reciprocate, controller 90 may determine whether estimated/calculated flow rate I" at which ink flows while the recording medium is conveyed at one step and the line head ejects ink is greater than or equal to minimum flow rate I. In other words, the ink ejection by the line head while the recording medium is conveyed at one step may be an example of the predetermined operation of the line head.

In another embodiment, if a recording head is a line head, controller 90 may estimate/calculate flow rate I" by dividing an amount of ink required for recording an image on one sheet of recording paper by a period of time required for recording the image on one sheet of recording paper. In other words, the ink ejection by the line head for recording an image on one sheet of recording paper may be an example of the predetermined operation of the line head.

When recoding head 29 and carriage 21 moves relatively fast in the scanning direction, a relatively large acceleration is added to ink in ink tube 20, which causes ink to move between recording head 29 and ink cartridge 30. The acceleration may be sufficient to cause ink to flow at a flow rate greater than or equal to minimum flow rate I. In other words, only the movement of recording head 29 in the scanning direction without ejecting ink from recording head 29 may cause ink to flow at a flow rate greater than or equal to minimum flow rate I. Therefore, in another embodiment, the predetermined operation of recording head 29 may comprise a one-way movement of recording head 29 in the scanning direction without ejecting ink from recording head 29.

Figure 7:
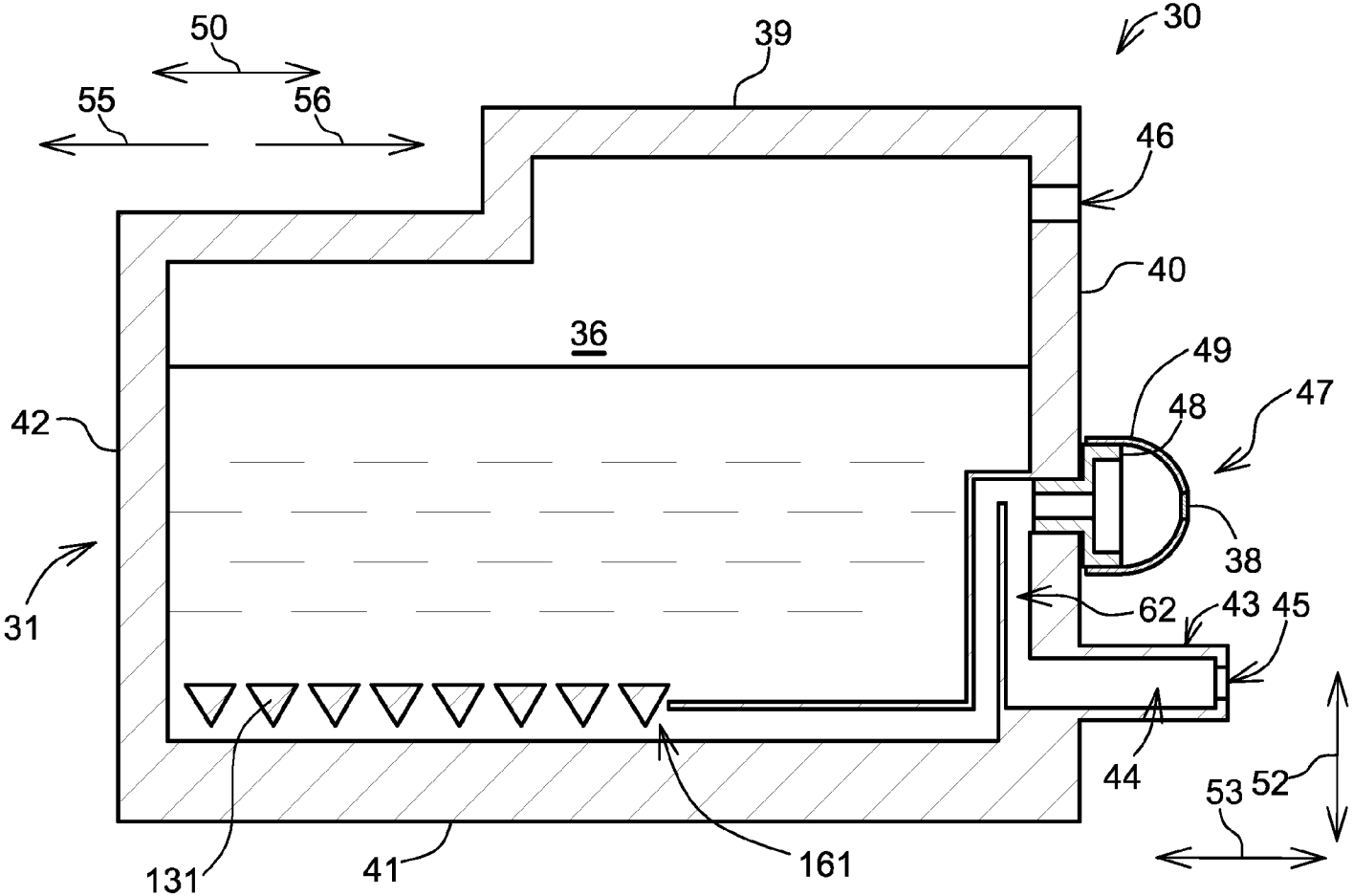
FIG. 7 is a vertical, cross-sectional view of an ink cartridge according to yet another embodiment.

Referring to FIG. 7, in another embodiment, case 31 may comprise a plurality of bars 131 aligned in depth direction 53 at a lower portion of ink chamber 36. Each of bars 131 may extend between the side walls (not shown) of case 31 in the width direction, and may have an inverted triangle cross-sectional shape in a cross-sectional plane which is parallel with height direction 52 and depth direction 53. At least a portion of a first outflow path 161 may comprise spaces formed between the bars 131. Flow resistance R of first outflow path 161 may depend on the size of the space between bars 131. The size of the space between bars 131 may be set such that the above-described condition No. 1 is satisfied. In this embodiment, even if air bubbles enter first outflow path 161, air bubbles may move up and may escape from first outflow path 161 through the spaces between bars 131 or may be trapped between bars 131. Therefore, the air bubbles may not affect the movement of diaphragm rubber 49.

While the invention has been described in connection with various example structures and illustrative embodiments, it will be understood by those skilled in the art that other variations and modifications of the structures and embodiments described above may be made without departing from the scope of the invention. Other structures and embodiments will be understood by those skilled in the art from a consideration of the specification or practice of the invention disclosed herein. It is intended that the specification and the described examples are merely illustrative and that the scope of the invention is defined by the following claims.

The invention claimed is:

1. An image recording apparatus comprising:

a liquid chamber configured to store liquid therein and configured to be in fluid communication with atmospheric air;

a first path configured to allow the liquid to flow out of the liquid chamber therethrough, wherein the first path has a flow resistance R when the liquid flows through the first path;

a second path configured to be connected to the first path, wherein the second path has an internal pressure;

a recording head configured to eject the liquid supplied via the second path, wherein the recording head is configured such that a predetermined operation of the recording head causes the liquid to flow to the recording head at a flow rate greater than or equal to a minimum flow rate I;

a pressure responsive portion comprising a membrane configured to move in response to the internal pressure of the second path and configured to move when a pressure differential between inside and outside of the membrane is greater than or equal to a minimum pressure differential ΔP;

a detector configured to detect a position of the membrane; and a controller configured to determine presence of the liquid in the liquid chamber based on detection by the detector, wherein the flow resistance R, the minimum pressure differential ΔP, and the minimum flow rate I are set, such that the following condition is satisfied:

flow resistance $R \geq$(minimum pressure differential $\Delta P$/minimum flow rate $I$).

2. The image recording apparatus of claim 1, wherein the pressure responsive portion has a space formed therein, and the space is connected to the second path, wherein the membrane at least partly defines the space and is configured to deform into the space when the pressure differential between inside and outside of the membrane is greater than or equal to the minimum pressure differential ΔP, wherein the detector is configured to detect whether the membrane is in a deformed position where the membrane is deformed into the space.

3. The image recording apparatus of claim 2, wherein the controller is configured to determine that the liquid chamber has the liquid therein if the detector detects that the membrane is in the deformed position within a predetermined period of time since the recording head starts the predetermined operation, and the controller is configured to determine that the liquid chamber is empty of the liquid if the detector does not detect that the membrane is in the deformed position within the predetermined period of time since the recording head starts the predetermined operation.

4. The image recording apparatus of claim 1, further comprising a liquid cartridge and a cartridge mounting portion, wherein the liquid cartridge is configured to be removably mounted to the cartridge mounting portion, and the liquid cartridge comprises the liquid chamber and the first path.

5. The image recording apparatus of claim 4, wherein the first path comprises a connection portion configured to be connected to the second path, and the connection portion of the first path has a flow resistance R' when the liquid flows through the connection portion, wherein the flow resistance R', the minimum pressure differential ΔP, and the minimum flow rate I are set, such that the following condition is satisfied:

flow resistance $R' <$(minimum pressure differential $\Delta P$/minimum flow rate $I$).

6. The image recording apparatus of claim 4, wherein the liquid cartridge comprises the pressure responsive portion.

7. The image recording apparatus of claim 1, further comprising a carriage configured to reciprocate together with the recording head in a scanning direction, and the predetermined operation of the recording head comprises a one-way movement of the recording head in the scanning direction.

8. The image recording apparatus of claim 1, wherein the predetermined operation of the recording head comprises a flushing operation of the recording head.

9. The image recording apparatus of claim 1, wherein the controller is configured to determine, based on bitmap data of an image to be recorded by the recording head on a recording medium, whether a flow rate of the liquid required for recording the image is greater than or equal to the minimum flow rate I, wherein the predetermined operation of the recording head comprises a recording operation for recording the image when it is determined that the flow rate of the liquid required for recording the image is greater than or equal to the minimum flow rate I.

10. A liquid cartridge configured to be removably mounted to a cartridge mounting portion and to supply liquid to a recording head via the cartridge mounting portion, wherein the recording head is configured to eject the liquid and configured such that a predetermined operation of the recording head causes the liquid to flow to the recording head at a flow rate greater than or equal to a minimum flow rate I, the liquid cartridge comprising:

a liquid chamber configured to store the liquid therein and configured to be in fluid communication with atmospheric air;

a first path configured to allow the liquid to flow out of the liquid chamber therethrough, wherein the first path has a flow resistance R when the liquid flows through the first path;

a second path configured to be connected to the first path, wherein the second path has an internal pressure;

a pressure responsive portion comprising a membrane configured to move in response to the internal pressure of the second path and configured to move when a pressure differential between inside and outside of the membrane is greater than or equal to a minimum pressure differential ΔP;

wherein the flow resistance R, the minimum pressure differential ΔP, and the minimum flow rate I are set, such that the following condition is satisfied:

flow resistance $R \geq$(minimum pressure differential $\Delta P$/minimum flow rate $I$).

11. The liquid cartridge of claim 10, wherein the pressure responsive portion has a space formed therein, and the space is connected to the second path, wherein the membrane at least partly defines the space and is configured to deform into the space when the pressure differential between inside and outside of the membrane is greater than or equal to the minimum pressure differential ΔP.

12. A liquid cartridge comprising:

a liquid chamber configured to store liquid therein and configured to be in fluid communication with atmospheric air;

a first path configured to allow the liquid to flow out of the liquid chamber therethrough;

a second path configured to be connected to the first path, wherein the second path has an internal pressure; and a pressure responsive portion comprising a membrane configured to move in response to the internal pressure of the second path and configured to move when a pressure differential between inside and outside of the membrane is greater than or equal to a minimum pressure differential.

13. The liquid cartridge of claim 12, wherein the pressure responsive portion has a space formed therein, and the space is connected to the second path, wherein the membrane at least partly defines the space and is configured to deform into the space when the pressure differential between inside and outside of the membrane is greater than or equal to the minimum pressure differential.

* * * * *